US006206536B1

(12) United States Patent
Lin

(10) Patent No.: US 6,206,536 B1
(45) Date of Patent: Mar. 27, 2001

(54) TABLE LAMP WITH MOVABLE ORNAMENTAL LIQUID CONTAINER

(76) Inventor: Rich Lin, 17F, No. 309, Sec. 2, Wen Hua Rd, Panchiao, Taipei Hsien (TW)

( * ) Notice: Subject to any disclaimer, the term of this patent is extended or adjusted under 35 U.S.C. 154(b) by 0 days.

(21) Appl. No.: 09/306,461

(22) Filed: May 7, 1999

(51) Int. Cl.[7] ..... G09F 19/00

(52) U.S. Cl. ..... 362/101; 362/96; 362/101; 362/806; 362/318; 446/156; 446/159; 446/180; 446/267; 446/491

(58) Field of Search ..... 362/96, 101, 806, 362/318; 446/156, 159, 180, 267, 491

(56) References Cited

U.S. PATENT DOCUMENTS 4,072,855 * 2/1978 Marchese ..... 362/101
5,272,604 * 12/1993 Lin ..... 362/96
5,292,564 * 3/1994 Lee ..... 428/13
5,678,918 * 10/1997 Lin ..... 362/96
5,706,595 * 1/1998 Lin ..... 40/406
6,001,433 * 12/1999 Meng ..... 428/13
6,003,392 * 12/1999 Lee ..... 446/267
6,022,122 * 2/2000 Limardo ..... 362/191

* cited by examiner

*Primary Examiner*—Sandra O'Shea
*Assistant Examiner*—Anabel M. Ton
(74) *Attorney, Agent, or Firm*—Dougherty & Troxell

(57) ABSTRACT

A table lamp having an ornamental liquid container movably connected to a main body thereof, so that the ornamental liquid container tends to swing, rotate and/or turn upside-down under an external force applied on the ornamental liquid container. At least one type of liquid, such as a dual-liquid or a magma-like liquid, and floating ornaments are contained in the ornamental liquid container. The liquid and floating ornaments tend to create unique, changeful and dynamic scenes when the ornamental liquid container is moved by the external force applied on it. The ornamental liquid container therefore gives the table lamp novel appearances and additional decorative effect.

3 Claims, 5 Drawing Sheets

TABLE LAMP WITH MOVABLE ORNAMENTAL LIQUID CONTAINER

BACKGROUND OF THE INVENTION

The present invention relates to a table lamp with movable ornamental liquid container, and more particularly to a table lamp having an ornamental liquid container movably mounted on a base of the table lamp, so that liquid and floating ornaments contained in the liquid container produce dynamical, changeful and beautiful scenes in the liquid container when the latter is moved by an external force applied on it. The table lamp therefore has unique ornamental effect apart from its illuminating function.

The table lamp is a very popular lighting fixture and may be versatilely designed. U.S. Pat. Nos. 5,272,604 entitled "Cyclonic Liquid Ornament" and 5,678,918 entitled "Lamp Stand" both granted to the inventor of the present invention, and U.S. patent application Ser. No. 08/888,833 entitled "A Lamp Seat Type Liquid Decoration" filed by the same inventor and having been paid of issuance fee, all disclose lamps having different dynamic decorative effect. There are also corresponding applications of the above-mentioned U.S. Patents and Patent Application being filed and granted a patent right in many other countries. A common feature of these earlier disclosed table lamps is they all include a liquid container fixedly mounted to an illuminating lamp body, and a motor for driving liquid and/or floating ornaments in the liquid container to move. That is, the liquid container itself does not move at all.

While these earlier disclosed table lamps having ornamental liquid container are structurally novel and unique in ornamental effect, they all have complicate components and accordingly require increased manufacturing cost that will adversely affect the competitive position of the table lamps in the market. However, as a matter of fact, some of the dynamical ornamental effect can be easily achieved, such as in a dual-liquid floating ornament that includes floating ornaments freely floating at an interface between two different liquids for quite a long time whenever the liquid container is vibrated. There is also a unique hourglass-like liquid container having a magma-like liquid contained therein. When the hourglass-like liquid container is turned upside-down, the magma-like liquid will naturally flow from an upper space in the liquid container to a lower space thereof. The time for the magma-like liquid to completely flow to the lower space is usually about three to five minutes that is long enough for producing continuously changeful liquid scenes in the liquid container.

SUMMARY OF THE INVENTION

It is therefore a primary object of the present invention to provide a table lamp having an ornamental liquid container movably mounted thereto in very simple manner to achieve very good decorative and ornamental effect. The liquid container can be easily swung, rotated or turned upside-down under only a minor external force applied on it, and causes liquid and floating ornaments contained in the liquid container to present changeful and beautiful scenes, so that the table lamp is useful not only in illumination but also in decoration.

DETAILED DESCRIPTION OF THE PREFERRED EMBODIMENTS

Figure 1:
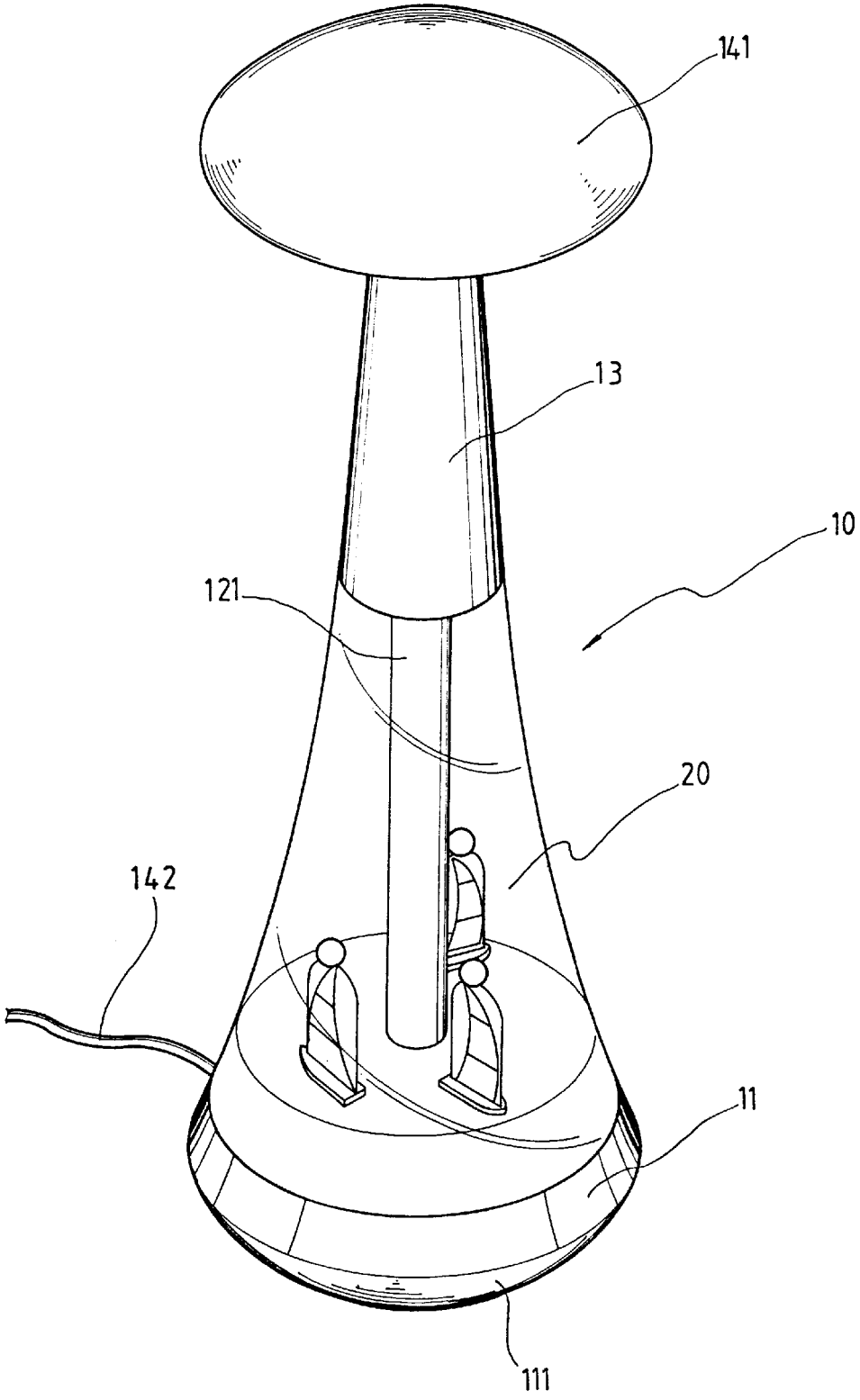
FIG. 1 is a perspective of a table lamp with movable ornamental liquid container according to a first embodiment of the present invention.
Figure 2:
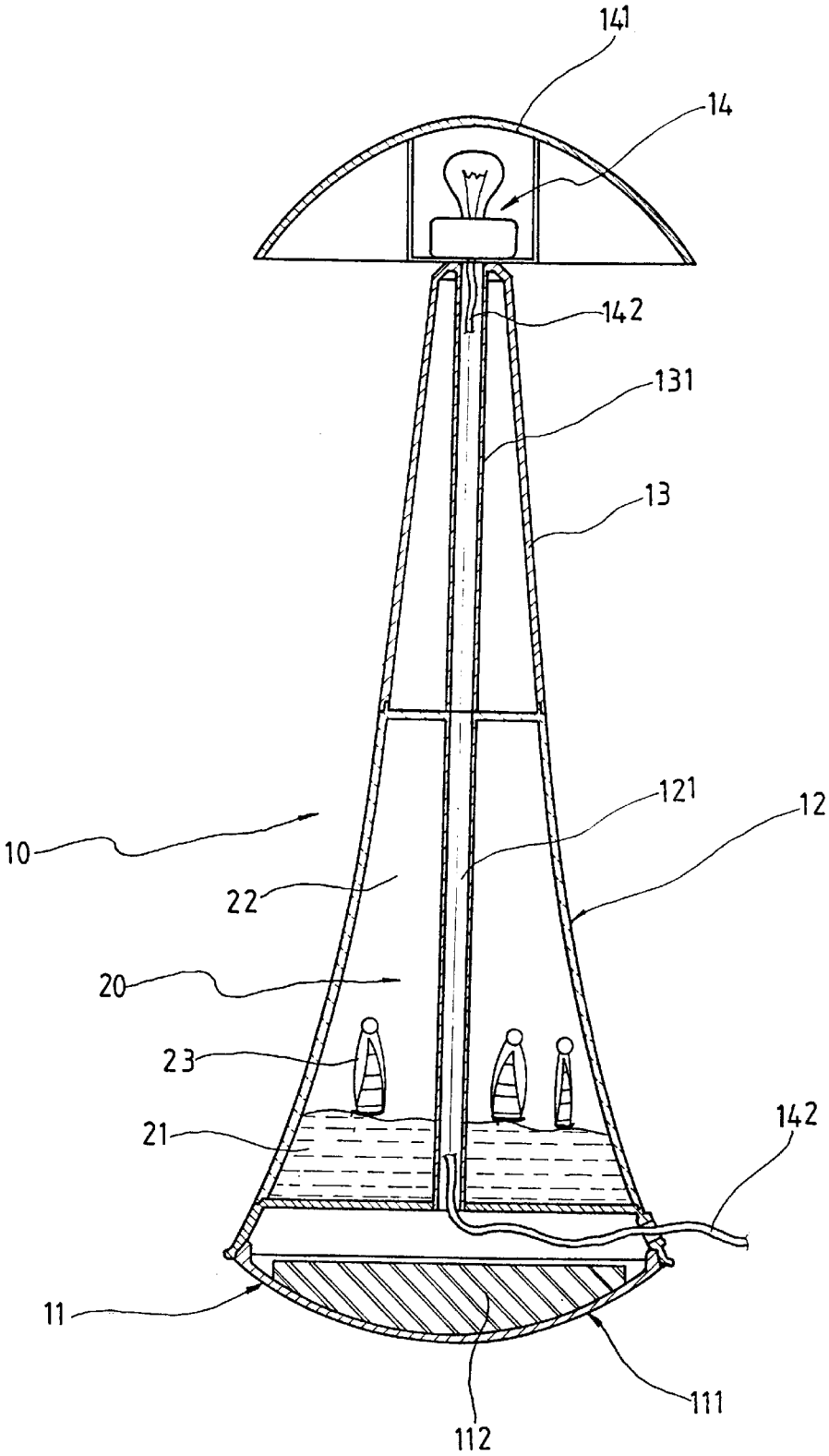
FIG. 2 is a vertical sectional view of the table lamp of FIG. 1.

Please refer to FIGS. 1 and 2 that are perspective and vertical sectional views, respectively, of a table lamp 10 according to a first embodiment of the present invention. As shown, the table lamp 10 mainly includes a base 11, an ornamental liquid container 12 mounted to a top of the base 11, a lamp holder support 13 mounted to a top of the liquid container 12, and a lamp holder 14 mounted to a top of the support 13.

The base 11 has a convex bottom surface 111 and a weight 112 fitted in the convex bottom surface 111, such that the whole table lamp 10 is structurally like a tumbler and is allowed to tilt in any direction within a proper angle of inclination without turning over and to always maintain an upstanding position when it is in a still condition.

The ornamental liquid container 12 has a central through hole 121 and has dual-liquid floating ornament 20 contained in a space defined by the ornamental liquid container 12. The dual-liquid floating ornament 20 includes a type of tinted liquid 21, a type of clear oil 22 and some floating ornaments 23, and is a currently very popular liquid type ornament.

The lamp holder support 13 also has a central through hole 131 aligned with the central through hole 121 of the ornamental liquid container 12.

The lamp holder 14 includes a lamp shade 142 and a conductor 142 that is sequentially routed through the central through holes 131 and 121 to the base 11 for connecting to an external power source (not shown).

Whereby when the whole table lamp 10 in a still condition is subjected to an external pull and therefore swings to and fro, the tinted liquid 21, the clear oil 22 and the floating ornaments 23 in the ornamental liquid container 12 are vibrated to show continuous changes that form a dynamic decoration for the table lamp 10.

From the above description, it can be easily understood the ornamental liquid container 12 is basically a movable component in the table lamp 10 of the present invention.

Figure 3:
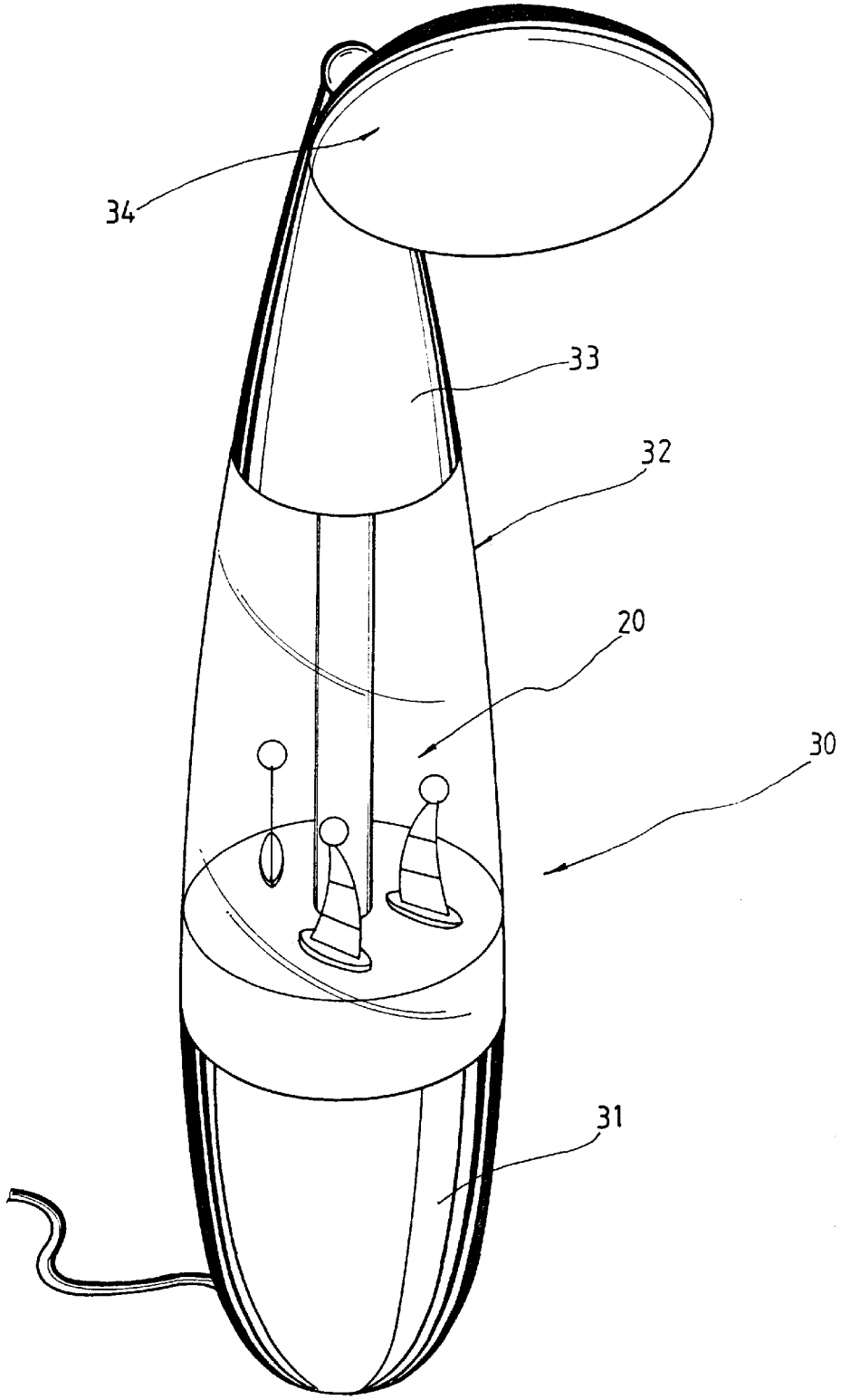
FIG. 3 is a perspective of a table lamp with movable ornamental liquid container according to a second embodiment of the present invention.

FIG. 3 illustrates a table lamp 30 according to another embodiment of the present invention and is also a tumbler-type lamp like the table lamp 10 of FIGS. 1 and 2. The table lamp 30 mainly includes a base 31, an ornamental liquid container 32 located above the base 31 and having a dual-liquid floating ornament 20 container therein, a lamp holder support 33 located above the ornamental liquid container 32, and a lamp holder 34 connected to a top of the lamp holder support 33. The table lamp 30 is structurally similar to the table lamp 10 but has differently shaped overall appearance compared to the table lamp 10.

Figure 4:
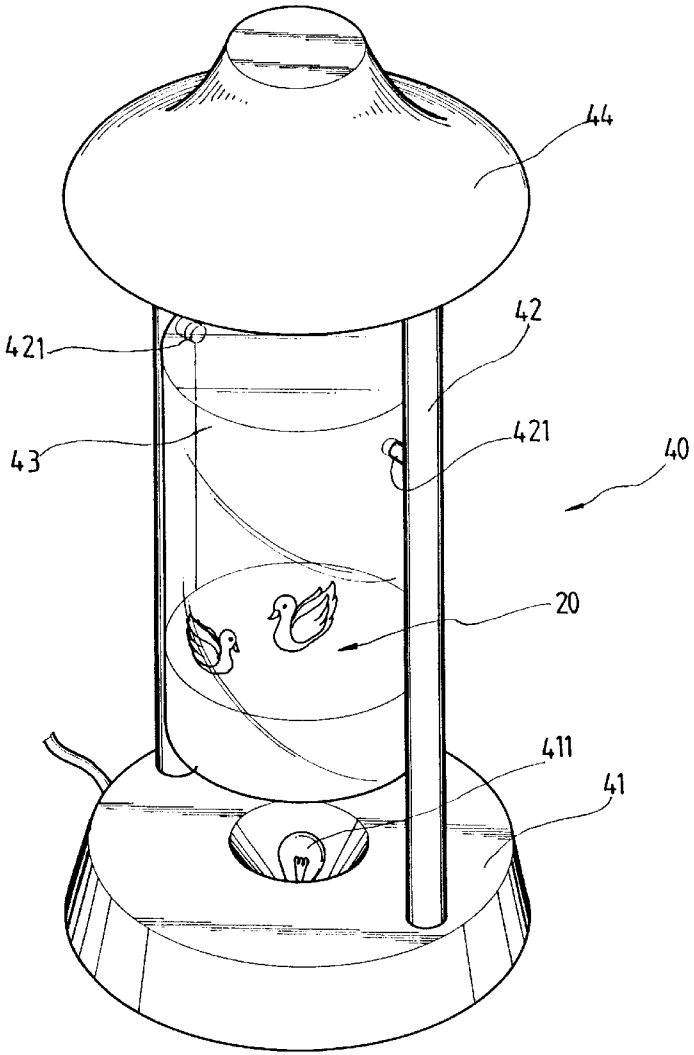
FIG. 4 is a perspective of a table lamp with movable ornamental liquid container according to a third embodiment of the present invention.

Please refer to FIG. 4 that shows a table lamp 40 according to a third embodiment of the present invention. In this embodiment, the table lamp 40 mainly includes a base 41, a pair of supporting posts 42 upright erected and spaced on the base 41, an ornamental liquid container 43 supported on and between the two supporting posts 42 and containing a dual-liquid floating ornament 20, and a lamp holder 44 mounted to a top of the two supporting posts 42. A small night lamp 411 may be connected to a top center of the base 41 to illuminate the ornamental liquid container 42. The ornamental liquid container 43 is supported on and between the two supporting posts 42 by pivotally connecting at two symmetrical points generally located within an upper half portion thereof to two pivotal shafts 421 separately sideward and inward extended from the two supporting posts 42. Whereby when the ornamental liquid container 43 is subjected to an external pull force applied on it, it will pivotally swing between the two posts 42 about the two pivotal shafts 421.

Figure 5:
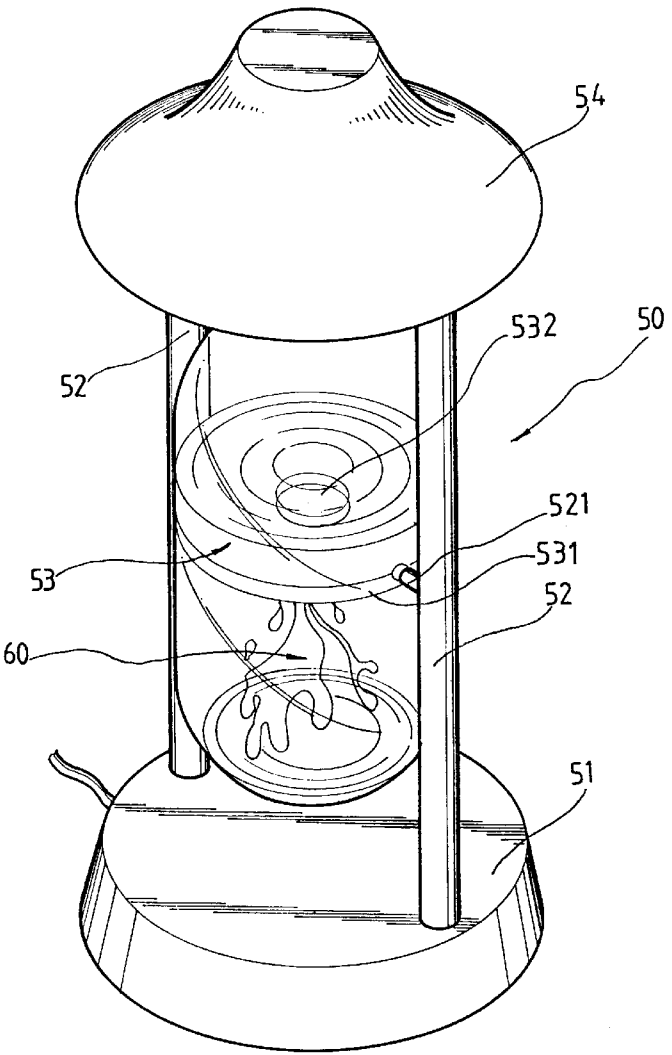
FIG. 5 is a perspective of a table lamp with movable ornamental liquid container according to a fourth embodiment of the present invention.

FIG. 5 shows a table lamp 50 according to a fourth embodiment of the present invention and mainly includes a base 51, two supporting posts 52 upright erected and spaced on the base 51, an ornamental liquid container 53 pivotally connected to and between the two supporting posts 52, and a lamp holder 54 mounted on a top of the two supporting posts 52.

The table lamp 50 is structurally similar to the table lamp 40 of FIG. 4, except that the ornamental liquid container 53 is supported on the supporting posts 52 by connecting two symmetrical and diametrically opposite middle points thereof to two pivotal shafts 521 separately sideward and inward extended from the two supporting posts 52, such that the whole ornamental liquid container 53 is allowed to turn upside-down about the two pivotal shafts 521 under an external pull force, and that a thick and viscous liquid 60 looking like magma is contained in the ornamental liquid container 53 and a middle partition 531 having a central hole 532 is provided in the ornamental liquid container 53 to divide the liquid container 53 into an upper half and a lower half. Whereby when the ornamental liquid container 53 is turned upside-down, the magma-like liquid 60 naturally flows from a space at an upper half of the ornamental liquid container 53 through the central hole 532 on the middle partition 531 into another space at a lower half of the ornamental liquid container 53 like a scene can be seen in a hourglass. When the thick and viscous magma-like liquid 60 flows through the small central hole 532 on the middle partition 531, it creates a unique, continuous and dynamic scene in the ornamental liquid container 53 and produces an excellent decorative effect. Although such liquid type ornament is known in the market, it has never been used with a table lamp. When the liquid container 53 is freely turned about the pivotal shafts 521 on the two supporting posts 52 and is illuminated by a lamp (not shown) connected to the lamp holder 54, it forms a good ornament associated with the table lamp 50 to add the value and novelty of the table lamp 50.

Figure 7:
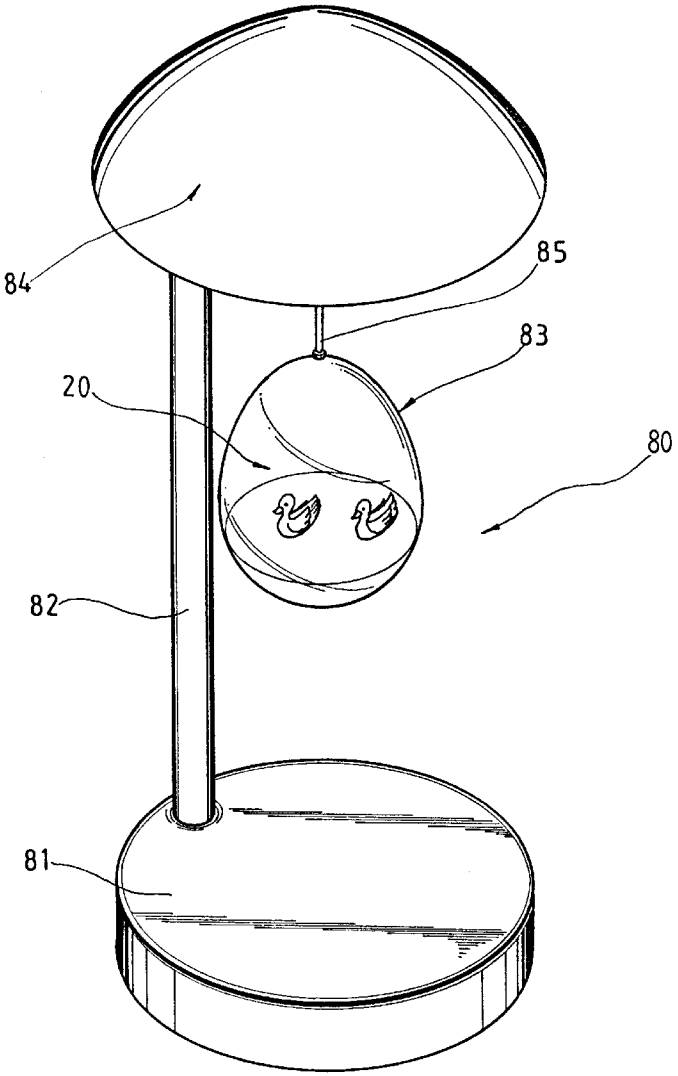
FIG. 7 is a perspective of a table lamp with movable ornamental liquid container according to a sixth embodiment of the present invention.
Figure 6:
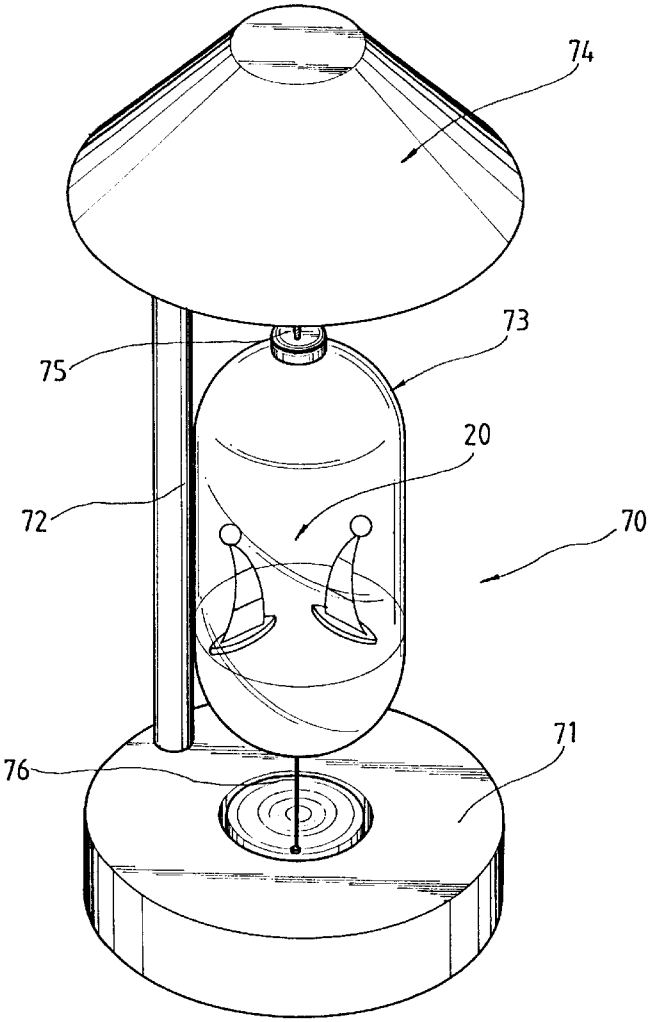
FIG. 6 is a perspective of a table lamp with movable ornamental liquid container according to a fifth embodiment of the present invention.

FIGS. 6 and 7 illustrate another two structurally similar table lamps 70 and 80, respectively, according to fifth and six embodiments of the present invention. Both the table lamps 70, 80 have a base 71, 81, a supporting post 72, 82, an ornamental liquid container 73, 83, and a lamp holder 74, 84. Both the ornamental liquid containers 73, 83 have dual-liquid floating ornament 20 contained therein to function as a dynamic ornament. The ornamental liquid container 73, 83 are suspended from an upper point of the table lamp 70, 80 by a suspended cord 75, 85 that is firmly connected at a lower end to a top of the ornamental liquid container 73, 83. There are many different ways acceptable for connecting the suspended cord 75, 85 to the ornamental liquid container 73, 83 without any particular limitation. Whereby the ornamental liquid container 73, 83 may move in different manners varied with the manners in which an external force is applied on the ornamental liquid container 73, 83. The dual-liquid floating ornament 20 inside the ornamental liquid container 73, 83 can therefore show dynamically changeful scenes.

In the embodiment of FIG. 6, a lower restraining cord 76 is provided and has an upper end connected to a bottom of the ornamental liquid container 73 and a lower end to a top of the base 71. With counter pulls of the upper suspended cord 75 and the lower restraining cord 76, the movement of the ornamental liquid container 73 may be limited to a predetermined range.

No matter how different the above-described table lamps are in their structural designs, they all include an ornamental liquid container, and particularly a movable ornamental liquid container that allows a user to apply a force on it in any manner and displaces under the applied force to cause dynamic changes in the liquid contained in the ornamental liquid container, and is therefore a good ornament associated with the table lamp to increase the latter's functions and value.

What is claimed is:

1. A table lamp with movable ornamental liquid container comprising a table lamp main body and an ornamental liquid container movably mounted on the table lamp main body, said ornamental liquid container having at least one type of ornamental liquid contained therein and ornaments floating on said at least one type of liquid, whereby when said ornamental liquid container is subjected to an external force applied on it, said ornamental liquid container is moved and causes said at least one type of liquid and said floating ornaments to produce changeful and dynamic scenes in said ornamental liquid container, and give said table lamp an additional ornamental function and increased value for use wherein said table lamp main body further includes a lamp holder support formed from two vertical posts erected and spaced on a top of said base, and said ornamental liquid container being pivotally mounted on said lamp holder support by connecting two pivotal shafts provided on said two posts to two diametrically opposite points on said ornamental liquid container, such that said ornamental liquid container may be swung or turned upside-down about said two pivotal shafts under an external force applied on said ornamental liquid container.

2. A table lamp with movable ornamental liquid container as claimed in claim 1, wherein said ornamental liquid container turns upside-down when an external force is applied on it, and said liquid and floating ornaments in said ornamental liquid container being a thick and viscous magma-like liquid.

3. A table lamp with movable ornamental liquid container comprising a table lamp main body and an ornamental liquid container movably mounted on the table lamp main body, said ornamental liquid container having at least one type of ornamental liquid contained therein and ornaments floating on said at least one type of liquid, whereby when said ornamental liquid container is subjected to an external force applied on it, said ornamental liquid container is moved and causes said at least one type of liquid and said floating ornaments to produce changeful and dynamic scenes in said ornamental liquid container, and give said table lamp an additional ornamental function and increased value for use wherein said table lamp main body has an upper suspended cord hanging from an upper point at said table lamp main body, a lower end of said suspended cord being connected to a top of said ornamental liquid container, so that said ornamental liquid container is in a suspended condition.

* * * * *